US006138775A

United States Patent [19]

Püttmann

[11] Patent Number: 6,138,775

[45] Date of Patent: Oct. 31, 2000

[54] BORING MACHINE

[75] Inventor: Franz-Josef Püttmann, Lennestadt, Germany

[73] Assignee: Tracto-Technik Paul Schimdt Spezialmaschinen, Lennestadt, Germany

[21] Appl. No.: 09/096,229

[22] Filed: Jun. 11, 1998

[30] Foreign Application Priority Data

Jun. 13, 1997 [DE] Germany ..... 197 25 052

[51] Int. Cl.[7] ..... E21B 1/12

[52] U.S. Cl. ..... 175/67; 175/417

[58] Field of Search ..... 175/296, 415, 175/407, 417, 414, 67

[56] References Cited

U.S. PATENT DOCUMENTS

| | | | |
|---|---|---|---|
| 3,865,200 | 2/1975 | Schmidt . | |
| 4,290,496 | 9/1981 | Briggs . | |
| 4,819,745 | 4/1989 | Walter | 175/107 |
| 5,040,621 | 8/1991 | Lof | 175/258 |
| 5,301,758 | 4/1994 | Jenne | 175/21 |
| 5,332,048 | 7/1994 | Underwood et al. | 175/26 |
| 5,435,401 | 7/1995 | Hedlund et al. | 175/296 |
| 5,833,017 | 11/1998 | Woods et al. | 175/320 |

FOREIGN PATENT DOCUMENTS

| | | |
|---|---|---|
| 0 195 559 | 9/1986 | European Pat. Off. . |
| 0 335 543 | 10/1989 | European Pat. Off. . |
| 30 37 033 | 4/1981 | Germany . |
| 33 15 124 | 10/1984 | Germany . |

*Primary Examiner*—Frank S. Tsay

[57] ABSTRACT

In a percussion boring machine for producing or widening earth boreholes, the housing is equipped with nozzles and houses a striking piston caused to reciprocate axially by means of compressed air and means of generating pressure which supplies the nozzles with a flushing, cutting, lubricating and/or steering liquid. Since the liquid pressure required for the excavation of the ground surrounding the machine and/or for causing the machine to travel on a curved path is generated in the machine itself, the machine only needs to be supplied through a supply line with a liquid at a slightly raised pressure.

13 Claims, 2 Drawing Sheets

BORING MACHINE

FIELD OF THE INVENTION

The invention relates to an apparatus and a method, for example for the production or widening of earth boreholes and for laying underground lines without digging a trench or for driving pipes into the ground.

BACKGROUND AND PRIOR ART

Such apparatus, for example percussion boring machines, usually include an automatic striking piston which is caused to reciprocate in the interior of a housing by means of a fluid, for example compressed air, and which imparts its kinetic energy completely to the housing either directly or indirectly through a striking tip which is axially movable in the housing, and possibly also to the ground. In this way the apparatus performs both breaking-up and also displacement and driving work.

Boring machines are also known which not only displace the ground but also excavate it and, for example, convey it away counter to the direction of advance.

Finally, there are boring machines which permit not only straight-ahead boring but also curved boring. Such machines, for example, have a drilling head which is provided with a steering or oblique face which during straight-ahead boring rotates substantially constantly about the axis of the machine but in the case of boring along a curve is at least temporarily non-rotatable. To make this possible the machine may be provided with a drill string or linkage which is connected to a rotary and feed drive.

To facilitate the advance of the machine and/or the conveying away of the spoil it is also known to provide the machine in the region of the drilling head with nozzles which are supplied through a drill string or linkage with a flushing liquid, usually a suspension of bentonite. However, as in the case of the boring machine according to European application 0 195 559, the nozzles may also be supplied with a liquid at such a high pressure that a cutting jet is formed for excavating the ground in the region of the drilling head.

The machines which hydraulically excavate and/or convey away the soil and the machines operating with a steering jet are connected via a hosepipe or a drill string or linkage to an external pump which produces the pressure required in the particular case. The pressures required vary widely: they range from a few bar in the case of drilling with a flushing liquid to over 100 bar in the case of drilling with a cutting jet. Pressures greater than 100 bar are necessary in particular in the case of hard ground conditions. The pumps, which furthermore are subjected to heavy wear when the liquid used is a suspension of bentonite, are correspondingly expensive.

OBJECT OF THE INVENTION

From this starting point, it is an object of the invention to reduce the technical and economic outlay for the production of the liquid pressure required in boring machines equipped with jets, in particular percussion boring machines, while still making operation at high pressures possible.

SUMMARY OF THE INVENTION

To this end, in accordance with the invention it is proposed to provide, in a machine having—preferably solid—pistons which are caused to reciprocate in its housing, a pressure chamber in communication with nozzles for the flushing, lubricating, cutting and/or steering liquid. Since the pressure build-up takes place in the machine itself, the pressure chamber need only be supplied with liquid at low pressure. For this purpose only a purely gravity feed or a conventional feed pump which is capable of feeding the liquid over even fairly long stretches will suffice, while the operating pressure of the liquid is produced in situ, i.e. in the interior of the machine. Hence the machine does not need to be connected to the feed pump by a high pressure line. Since borehole lengths of up to 200 m or more occur in practice, this results in a considerable saving in cost. The same advantage is also obtained in the event that the liquid is led to the drilling or displacement head not via a hose but through a driven drill string or linkage.

The generation of pressure in situ is preferably done by means of a pressure piston, axially movable in the chamber, which is always restored to its starting position by means of a return spring. The piston may be in the form of an automatic piston, and it preferably has a closed front end face and has no bores for pressure medium.

A particularly simple construction results if the pressure piston is operatively connected to a striking piston reciprocated—preferably pneumatically—in the machine housing, such as is present in conventional percussion boring machines. Such a—preferably automatic—striking piston can then deliver both energy to drive the machine forward and also energy for excavation and for driving the pressure piston. In particular, this is done by the striking piston transferring at least part of its kinetic energy to the pressure piston. To make this possible, the pressure piston may be provided with a rear spigot which reaches through an internal collar of the housing. This spigot acts as an anvil for the striking piston. If the projecting length of the spigot is less than the maximum stroke of the pressure piston, the striking piston imparts its residual kinetic energy to the internal collar when the pressure piston spigot moves forwards in the piston chamber.

In this case the work to be performed by the striking piston comprises two phases: a compression phase, during which the striking piston and the pressure piston cooperate through the spigot, and a driving phase, in which the striking piston imparts its residual kinetic energy to the machine housing through the internal collar and thus causes it to drive forward. The pressure piston then returns to its starting position under the influence of a pressure fluid and/or of a return spring and the striking piston, and begins a new working cycle.

The pressure chamber can be supplied with liquid through a fixed line in the housing in which there is a valve, for example a non-return valve. Further, the pressure chamber can be in the form of an axial pressure passage which leads to at least one nozzle and into which the liquid supply line also opens.

The liquid supply line can open into the pressure chamber in the space in front of the front face of the piston in the forward position of the piston. Another possibility, however, is for the piston to periodically bridge over the opening in the wall of the pressure chamber and thereby alternately open and close it.

The apparatus in accordance with the invention can also be disposed at the beginning or at the end of a preferably driven linkage or engage in a pipe which is being advanced. In all cases a pulsating stream of pressure fluid is obtained which can be employed to excavate the ground, to steer a boring or widening machine located in the ground or to convey away the loosened spoil. The generation of pressure can take place under or above the ground. However, the generation of pressure in situ underground is particularly advantageous.

BRIEF DESCRIPTION OF THE DRAWINGS

The invention will now be described, by way of example, with reference to an embodiment illustrated in the drawings, in the form of a percussion boring machine having the general construction disclosed for example in German specification 2 157 259. In the drawings.

DETAILED DESCRIPTION OF A PREFERRED EMBODIMENT OF THE INVENTION

Figure 1:
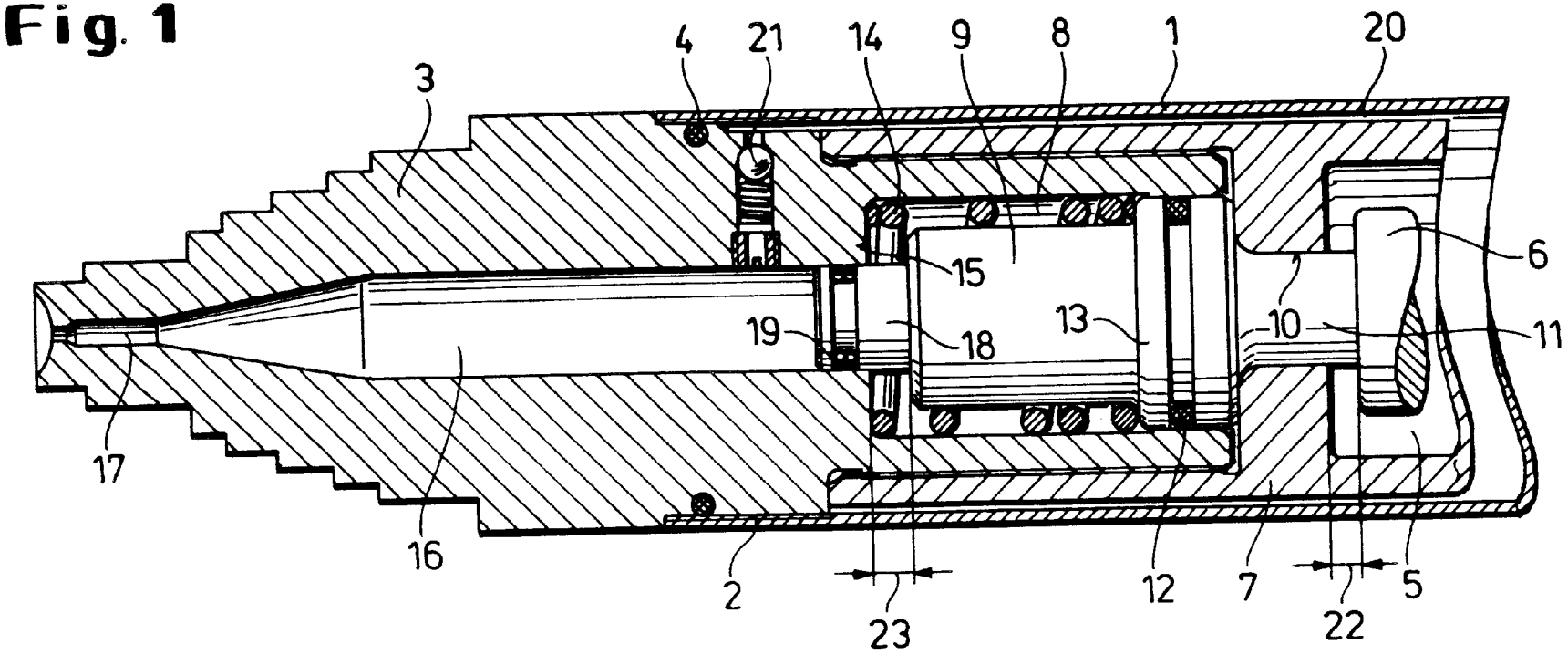
FIG. 1 shows the front part of the percussion boring machine.
Figure 2:
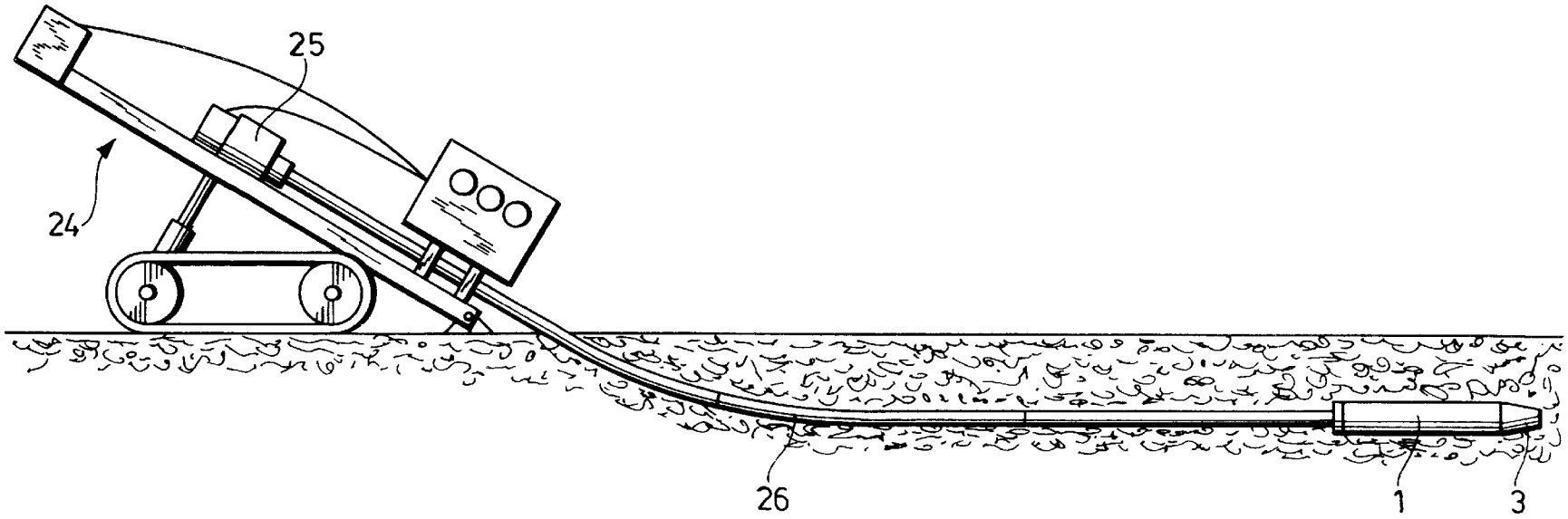
FIG. 2 shows a machine of the kind illustrated in FIG. 1 at the end of a driven linkage.

The percussion boring machine comprises a housing 1 which is provided at its forward end with a screw thread 2 into which is screwed a machine tip in the form of a stepped head 3 with a seal 4. In the housing there is a working chamber 5 in which a pneumatically driven automatic striking piston 6 reciprocates. Further details as to this can be found in the above-mentioned patent specification.

The working chamber 5 is separated by an internal collar 7 from a piston chamber 8 located in front of it in the direction of advance and housing a pressure piston 9. At the rear end of the pressure piston 9 there is a spigot 11 which passes through a bore 10 in the internal collar 7 and is in operative connection with the striking piston 6.

The pressure piston 9 is further provided with a sealing ring 12 in contact with the wall of the piston chamber 8, and has a collar 13 by means of which it is supported via a return spring 14 on a shoulder 15 of the striking tip 3. From the piston chamber 8 a pressure passage 16 leads to a nozzle 17 at the forward end of the striking tip 3. A front spigot 18 of the pressure piston 9 projects into this pressure passage and seals the pressure passage off from the piston chamber 8 by means of an O-ring seal 19. A low pressure liquid line 20 fixed in the housing and provided with a feed pump (not shown) opens into the pressure passage 16, and is provided with a non-return valve 21 which periodically feeds liquid into the pressure passage.

Under the influence of the return spring 14, the pressure piston 9 is located in its rear end position. In this position the spigot 11 projects beyond the internal collar 7 by the distance 22, which is less than the distance 23 between the forward face of the pressure piston 9 and the shoulder 15. The result of this is that over the distance 22 the striking piston 6 first imparts its kinetic energy to the pressure piston 9, and on reaching the internal collar 7 it imparts the rest of its kinetic energy to the machine housing 1, while the end of the spigot 11 sinks into the bore 10 in the collar until the pressure piston 9 has reached its forward end position at the shoulder 15 and returned to its starting position, as illustrated, under the influence of the return spring 14.

During its forward movement the pressure piston increases the pressure in the liquid present in the pressure passage 16, which issues from the nozzle 17 at the frequency of the striking piston movement, according to the pressure in the particular case and the constitution and alignment of the nozzle 17, as a lubricating or flushing liquid, a cutting jet excavating the ground, and/or as a steering jet.

The external feed pump can also be replaced by an external liquid container which is connected to the compressor which is generally required for the operation of the percussion boring machine or the movement of the striking piston 6 and feeds the liquid, for example water or a water-bentonite suspension, through the passage 20 in the housing to the pressure chamber or pressure passage 16.

While part of the energy of the striking piston 6 is used to raise the pressure by means of the pressure piston 9, this energy is nevertheless not completely lost, since the liquid issuing through the nozzle 17 softens or even excavates the ground in the region of the machine tip 3, and furthermore reduces the frictional resistance between the ground and the percussion boring machine.

The machine can also be provided with a number of mutually independent nozzles which serve different purposes. Thus one nozzle can produce a cutting jet, while other nozzles, for example inclined relative to the axis of the machine, produce steering jets and further nozzles deliver flushing liquid which reduces the resistance to displacement and the frictional resistance at the machine and/or facilitate conveying away of loosened spoil.

If at least one nozzle is disposed so that excavation of the ground on one side results, the machine moves along a curved course having its center of curvature on the side of the unilateral excavation of the ground. If the position of such a nozzle can be changed, for example if the machine is fitted at the end of a rotatable drill string or linkage 26 mounted on a carriage 24 having a rotary and linear drive 25, it is possible to change the direction of the curved track by turning the string or the machine. Independently of this, however, the radius of curvature of the machine track can be altered by increasing or decreasing the pressure of the cutting jet which is excavating the ground.

Apart from its construction, the apparatus creates a possibility, by means of a pulsating jet of liquid, of excavating ground, influencing the direction of boring or advance and/or of conveying away excavated spoil.

What is claimed is:

1. An apparatus for the production or widening of earth boreholes or for introducing lines into the ground, comprising a housing, a pressure piston that reciprocates in the housing, wherein the pressure piston has a closed front face, at least one nozzle disposed in the housing suitable for dispensing a cutting, lubricating, flushing and/or steering liquid, a pressure chamber disposed in the housing and in communication with the nozzle and a liquid supply line connected to the pressure chamber.

2. The apparatus as claimed in claim 1, further comprising a piston chamber, wherein the pressure piston is axially movable in the piston chamber.

3. The apparatus as claimed in claim 2, wherein a return spring acts on the pressure piston.

4. The apparatus as claimed in claim 1, further comprising a striking piston, wherein the pressure piston and the striking piston are operatively connected with one another.

5. The apparatus as claimed in claim 4, wherein the housing has an internal collar and the pressure piston has a rear end provided with a spigot that extends through the internal collar of the housing.

6. The apparatus as claimed in claim 5, wherein the distance by which the spigot projects is less than a maximum stroke of the pressure piston.

7. The apparatus as claimed in claim 1, wherein a valve is disposed in the liquid supply line.

8. The apparatus as claimed in claim 1, wherein at least one of the at least one nozzles is supplied with pressurized liquid through controllable valves.

9. The apparatus as claimed in claim 1, having a drill string or linkage provided with at least one of the group consisting of a rotary drive, a feed drive, and a rotary-feed drive.

10. The apparatus as claimed in claim 1, wherein a machine tip is connected to a drill string or linkage or a pipe which is being advanced.

11. The apparatus as claimed in claim 1, wherein the housing is connected to a driven carriage.

12. The apparatus as claimed in claim 1, wherein a return spring acts on the pressure piston.

13. Method for producing or widening earth boreholes, the method comprising driving a boring machine into the earth, the boring machine comprising:

a housing, a pressure piston that reciprocates in the housing, wherein the pressure piston has a closed front face, at least one nozzle disposed in the housing suitable for dispensing a cutting, lubricating, flushing and/or steering liquid, a pressure chamber disposed in the housing and in communication with the nozzle and a liquid supply line connected to the pressure chamber;

whereby the boring machine bores into the ground using a pulsating flushing, cutting, lubricating and/or steering liquid, ejected at high pressure from the boring head.

* * * * *